US006786005B1

(12) United States Patent
Williams

(10) Patent No.: US 6,786,005 B1
(45) Date of Patent: Sep. 7, 2004

(54) EMERGENCY RELEASE BURGLAR BARS ACTUATED BY SMOKE ALARM

(76) Inventor: Leo Williams, 12223 Swan River, Houston, TX (US) 77050

( * ) Notice: Subject to any disclaimer, the term of this patent is extended or adjusted under 35 U.S.C. 154(b) by 28 days.

(21) Appl. No.: 10/337,698

(22) Filed: Jan. 7, 2003

Related U.S. Application Data

(60) Provisional application No. 60/346,453, filed on Jan. 7, 2002.

(51) Int. Cl.[7] ..... E05B 65/10; E06B 3/68; G08B 17/10

(52) U.S. Cl. ..... 49/141; 49/50; 49/25; 340/628; 340/545.1

(58) Field of Search ..... 49/141, 26, 50, 49/394, 57, 56, 354, 25; 292/144; 70/DIG. 49; 340/628, 545.1, 546, 545.2, 547

(56) References Cited

U.S. PATENT DOCUMENTS 3,653,022 A * 3/1972 Tall ..... 340/545.1
4,127,966 A 12/1978 Schmidt
4,232,308 A * 11/1980 Lee et al. ..... 340/628
4,533,904 A * 8/1985 Steinman, Jr. ..... 340/546
4,771,574 A 9/1988 Stephens
4,837,560 A * 6/1989 Newberry ..... 340/628
4,862,141 A * 8/1989 Jordal ..... 340/545.1
4,962,954 A 10/1990 Ross
5,007,200 A 4/1991 Londono
5,334,971 A 8/1994 Raath
5,479,151 A * 12/1995 Lavelle et al. ..... 340/545.7
5,521,585 A * 5/1996 Hamilton ..... 340/628
6,035,676 A * 3/2000 Hudspeth ..... 292/144
6,218,939 B1 * 4/2001 Peper ..... 340/545.1
6,486,793 B1 * 11/2002 Buccola ..... 292/144
6,577,242 B2 * 6/2003 Jen et al. ..... 340/628

* cited by examiner

*Primary Examiner*—Hugh B. Thompson, II
(74) *Attorney, Agent, or Firm*—Kenneth A. Roddy

(57) ABSTRACT

Emergency release burglar bars having electronic locks that are actuated remotely by a signal generated by a smoke detector alarm provide security and will automatically unlock upon detection of smoke in the premises without human intervention to allow safe exit from the premises, and easy access and entry to the premises by emergency personnel. When the smoke detector/alarm senses smoke in the premises, its alarm is "powered on" to sound the alarm. A relay connected with the alarm circuit is activated simultaneously with the sounding of the alarm, which activates an "unlock" switch of a transmitter connected with the relay to transmit an RF "unlock" signal. Receivers on each of the electronic locks receive the transmitted signal, and activate an actuator, which actuates a mechanism to retract the bolt of the lock, allowing the burglar bars to be swung open.

14 Claims, 2 Drawing Sheets

EMERGENCY RELEASE BURGLAR BARS ACTUATED BY SMOKE ALARM

CROSS REFERENCE TO RELATED APPLICATION

This application claims priority of U.S. Provisional Application S.N. 60/346,453 filed Jan. 7, 2002.

BACKGROUND OF THE INVENTION

1. Field of the Invention

This invention relates generally to burglar bars, alarm devices and electronic lock devices, and more particularly to remote controlled emergency release burglars having an electronic lock that is actuated remotely by a signal generated by a smoke detector alarm.

2. Brief Description of the Prior Art

In many communities, homes and businesses must install burglar bars (security bars) or a security grill in the windows, and/or entryways of the premises to prevent criminal entry into the premises. Typically, the burglar bars or security grills are permanently affixed to the building exterior, or are mounted on hinges and provided with a lock that is opened by a key in the possession of the occupant, to prevent unauthorized removal, particularly from the outside of the building.

Although burglar bars may successfully prevent unauthorized break-ins, they can create a major safety problem in the event of a fire, since there may be no other exit available except through the windows and doorways of the premises. Burglar bars have been responsible for many deaths and destruction of property caused by fires because the occupant was unable to open the burglar bars or the emergency personnel were unable to enter the premises to control the fire or rescue the occupants. In the event of a fire, time is of the essence and significant delays or inoperability in releasing the burglar bars, or attempting to quickly locate the key for the lock could be life threatening.

Keyless electronic locks and electronic deadbolts that are actuated by remote control are also known in the art. Typically, such locking devices include an actuator that is coupled to a conventional dead bolt via various mechanisms, such as a connection rod, a solenoid, a motor, or a gear drive to extend and retract the deadbolt. The actuator is electrically and/or mechanically connected to a receiver that receives a signal sent from a remote transmitter in a remote control unit. The receiver activates the actuator, which, in turn actuates the mechanism to extend or retract the deadbolt.

Most of these prior art keyless electronic locks and electronic deadbolts are operated by a small remote transmitter or remote control unit, similar to the small transmitter that operates the locks on an a vehicle which is usually attached to a key chain or held in the hand of the operator. Though these devices may work successfully during normal circumstances, they may not offer protection during a fire, since the occupants of a burning building may be overcome by smoke, unconscious, or find themselves searching through their belongings in hopes of finding their transmitter quickly.

Schmidt, U.S. Pat. No. 4,127,966 discloses a locking and emergency release system for barred windows wherein the heavy iron gratings of a burglar-proof window are pivotally mounted on one side and the other side is provided with a latch type locking mechanism using a plunger having a ramped surface to hold a set of ball bearings in locking engagement with a matching cylinder. A small carbon dioxide container is mounted within the latch and is spring loaded with a detent arranged for actuation from within the home that is being protected. When the detent is released, a spring-loaded plunger punctures the carbon dioxide container, and a ramped latching plunger is moved to release the locking ball bearings, and then the iron grating or barrier is then vigorously swung open by the pneumatic pressure from the punctured container.

Stephens, U.S. Pat. No. 4,771,574 discloses a quick release burglar bar assembly mountable over a window or door opening in a building that may be quickly manually released from an interior portion of the building without a need for keys, or the like. A manually removable pin is pulled out of the lock mechanism to permit reciprocal movement of the locking bars, and a ring member may then be grasped to effect a reciprocal movement of the bars to thereby release the grill for swinging movement upon its hinges to allow a building occupant to escape through the window or door opening.

Ross, U.S. Pat. No. 4,962,954 discloses a burglar bar system incorporating a hand operated latch or lock enabling a hinged burglar bar gate to be opened by a person on the interior of the protected building. Intruders cannot reach the lock. The system includes a housing with an opening for hand engagement. In the opening, a spring supported lock member is pushed by hand to unlatch. Hand operation is constrained by the housing deployment, limiting use to a person near the housing and on the interior of the burglar bar gate.

Londono, U.S. Pat. No. 5,007,200 discloses a window bar security system having a grill of bars positioned outside a building window and held by a plurality of standoffs. Two of the standoffs are latching standoffs and extend from opposite sides of the grill through the wall and into the building and each latching standoffs includes a hole at the distal end. Four other guiding standoffs are inserted into receptacles against coil springs and the four guiding standoffs are positioned in pairs on opposite sides and equi-distant from each latching standoff. A pair of sliding bolt mechanisms are affixed to the inner wall of the building and positioned to permit the sliding bolt of each to fit into one of the latching standoff holes and to be moved towards the center of the window to release the latching standoffs. A pair of security pins are provided with one end designed to fit into a sliding bolt mechanism for preventing the unintentional movement of the sliding bolt and with another end shaped in the form of a hook. Each pin is tied by a string to a sliding bolt and the string is of such a length to permit the hooks of the two pins to be fastened together and still maintain the strings generally horizontal. To release the grill, the affixed strings are pulled to simultaneously move the sliding bolts out of the latching standoff holes. The pins and sliding bolt mechanism may be connected to an electronic security system.

Raath, U.S. Pat. No. 5,334,971 discloses a security device kit, a security device and a security installation, wherein a pair of spaced elongate primary security members extend in a first direction, and each has a plurality of longitudinally spaced openings. The ends of a plurality of elongate secondary security members, extending in a second direction, which is transverse to the first direction, are located in aligned openings in the primary security members. The ends of the secondary security members are thereby held captive in the primary security members. The secondary security members span a space between the primary security members, and the secondary security members are thus spaced apart from one another. A tertiary security member supports the secondary security members between the primary security members. An electrically operable burglar protection system, having an alarm, is connected to the security members.

To the inventor's knowledge, most of the prior are burglar bar locking systems and electronic keyless locks require human intervention to open the lock or to operate the remote transmitter, and none of the prior art burglar bar systems are provided with electronic keyless locks, and none of the electronic keyless locks are associated with a smoke detector/sensor to automatically unlock the burglar bars in the event of a fire without human intervention.

The present invention is distinguished over the prior art in general, by emergency release burglar bars having electronic locks that are actuated remotely by a signal generated by a smoke detector alarm provide security and will automatically unlock upon detection of smoke in the premises without human intervention to allow safe exit from the premises, and easy access and entry to the premises by emergency personnel. When the smoke detector/alarm senses smoke in the premises, its alarm is "powered on" to sound the alarm. A relay connected with the alarm circuit is activated simultaneously with the sounding of the alarm, which activates an "unlock" switch of a transmitter connected with the relay to transmit an RF "unlock" signal. Receivers on each of the electronic locks receive the transmitted signal, and activate an actuator, which actuates a mechanism to retract the bolt of the lock, allowing the burglar bars to be swung open.

SUMMARY OF THE INVENTION

It is therefore an object of the present invention to provide emergency release burglar bars having an electronic lock that is actuated remotely by a signal generated by a smoke detector alarm.

It is another object of this invention to provide emergency release burglar bars having an electronic lock that normally remains locked to provide security but will automatically quickly unlock the bars upon detection of smoke in the premises without human intervention.

Another object of this invention is to provide emergency release burglar bars that will quickly automatically unlock upon detection of smoke to allow safe exit from the premises, and easy access and entry to the premises by emergency personnel.

Another object of this invention is to provide emergency release burglar bars that will automatically unlock upon detection of smoke even if the occupants are unconscious or unable to unlock the bars.

A further object of this invention is to provide emergency release burglar bars that will automatically unlock upon detection of smoke in a premises which are easily and quickly installed, and reset after activation.

A still further object of this invention is to provide an emergency release burglar bar and smoke alarm system that is simple in construction, inexpensive to manufacture, and rugged and reliable in operation.

Other objects of the invention will become apparent from time to time throughout the specification and claims as hereinafter related.

The above noted objects and other objects of the invention are accomplished by the present emergency release burglar bars having electronic locks that are actuated remotely by a signal generated by a smoke detector alarm provide security and will automatically unlock upon detection of smoke in the premises without human intervention to allow safe exit from the premises, and easy access and entry to the premises by emergency personnel. When the smoke detector/alarm senses smoke in the premises, its alarm is "powered on" to sound the alarm. A relay connected with the alarm circuit is activated simultaneously with the sounding of the alarm, which activates an "unlock" switch of a transmitter connected with the relay to transmit an RF "unlock" signal. Receivers on each of the electronic locks receive the transmitted signal, and activate an actuator, which actuates a mechanism to retract the bolt of the lock, allowing the burglar bars to be swung open.

DESCRIPTION OF THE PREFERRED EMBODIMENT

Figure 1:
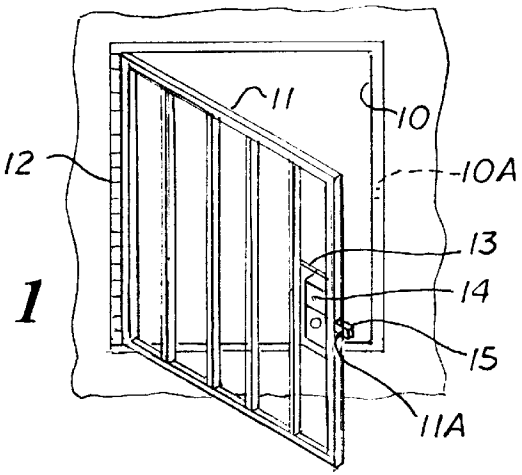
FIG. 1 is an elevation view of a burglar bar in accordance with the present invention installed in a window opening, shown with the burglar bar grill swung open.

In the following description, it should be understood that the term "burglar bars" is meant to include security bars and security grills of the type installed in the windows, doorways and entryways of a premises to prevent unauthorized entry. Referring now to FIG. 1, there is shown a generally rectangular metal frame 10 secured to a window opening. A burglar bar grill 11 is pivotally secured at one side to the frame 10 by hinges 12. The burglar bar grill 11 is sized and shaped to substantially fill the window opening, and includes a plurality of cross-extending metal bars welded or otherwise fastened together to form a grid pattern. A lock mounting plate 13 may be welded to the unhinged side of the grill 11. An electronic deadbolt lock 14 is secured to the lock mounting plate 13 and has a retractable bolt 15 which extends slidably through an aperture 11A in the peripheral side of the grill 11 and an adjacent aperture 10A in the surrounding frame 10.

Figure 2:
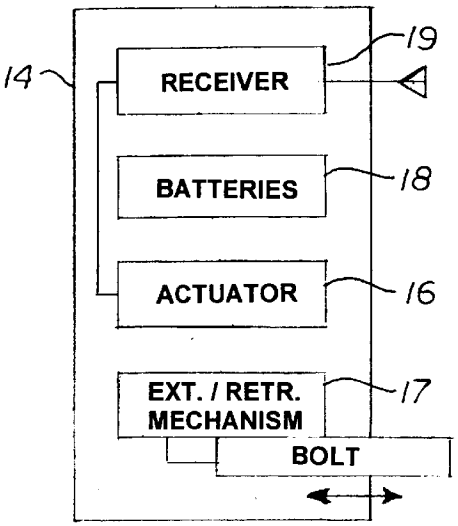
FIG. 2 is a schematic block diagram of the electronic deadbolt lock of the burglar bars.
Figure 4:
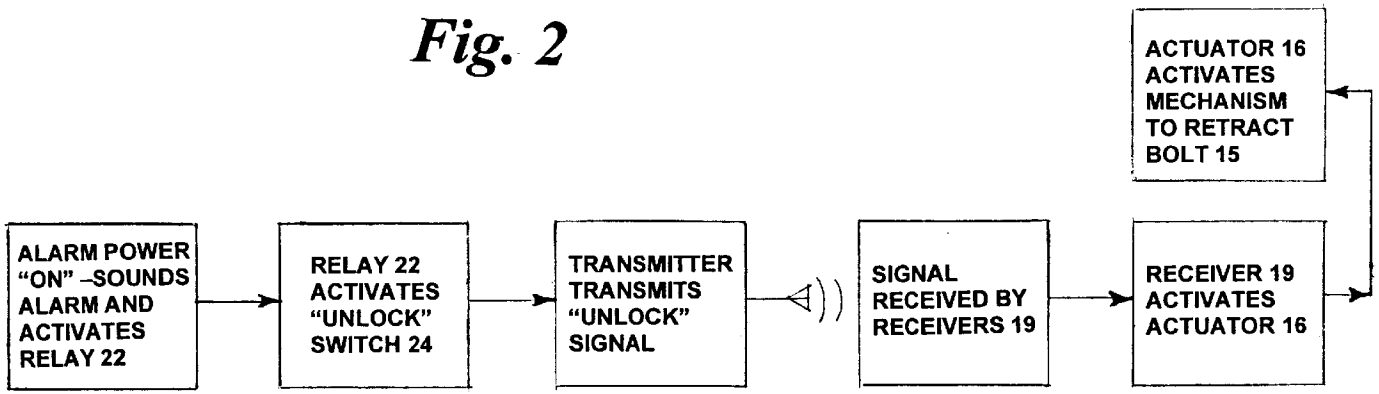
FIG. 4 is a block diagram illustrating the functional operation of the emergency release burglar bar and smoke alarm system.

As shown schematically in FIG. 2, the electronic lock 14 may be a commercially available electronic lock or electronic deadbolt of the type that is actuated by remote control signal. Such electronic locks or deadbolts are well known in the art and therefore the details of circuitry are not shown in detail. The electronic lock or deadbolt 14 includes an actuator 16 that is coupled to a conventional deadbolt 15 via various mechanisms 17, such as a connection rod, a solenoid, a motor, or a gear drive to extend and retract the bolt 15. The actuator 16 is powered by one or more DC batteries 18 and electrically and/or mechanically connected to a receiver 19 that receives a signal sent from a remote transmitter. The receiver 19 activates the actuator 16, which, in turn actuates the mechanism 17 to extend or retract the bolt 15 through the aperture 11A in the peripheral side of the grill 11 and the adjacent aperture 10A in the surrounding frame 10. Suitable commercially available electronic locks for use in the present invention are known as "Titan AccessOne solid brass keyless entrance handlesets and deadbolts, manufactured by Kwikset Corporation of Lake Forest, Calif.

Figure 3:
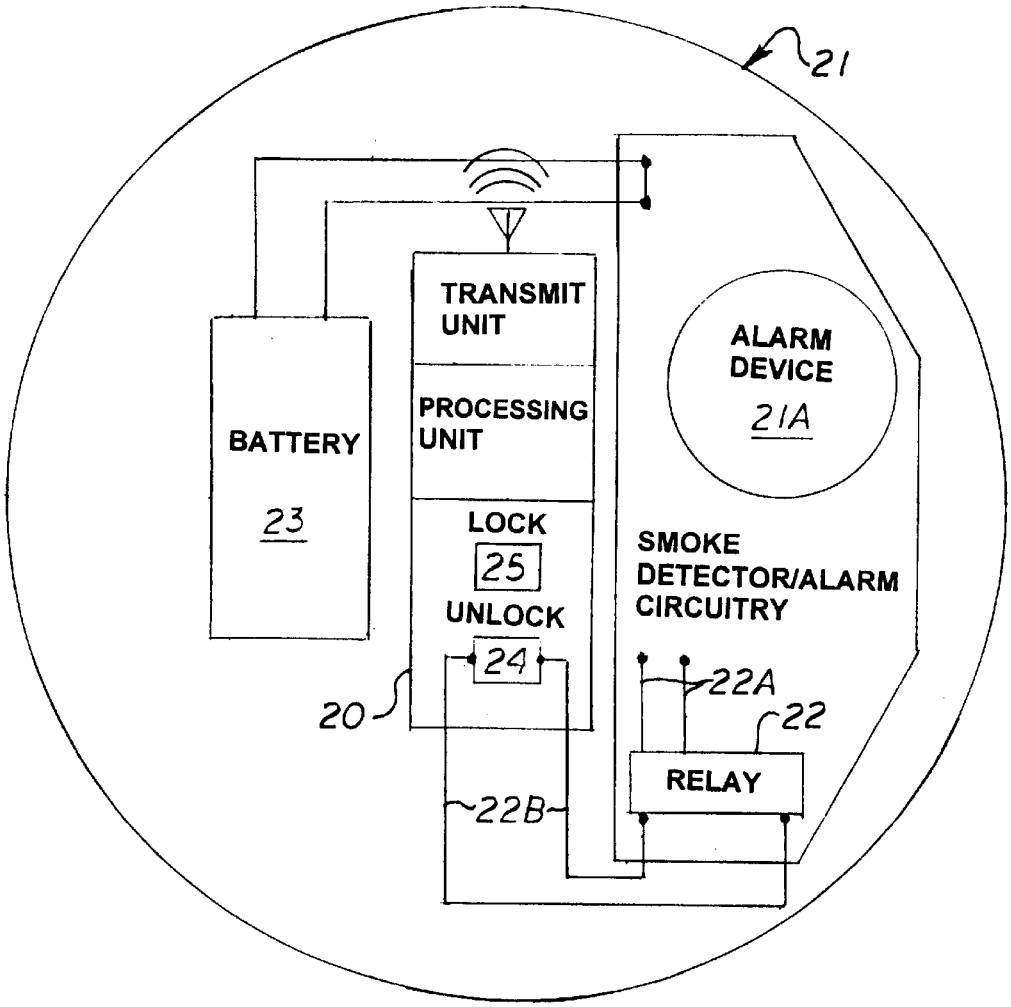
FIG. 3 is a schematic block diagram illustrating a smoke detector/alarm having a relay and transmitter connected with the conventional circuitry.

Referring additionally to FIG. 3, the remote transmitter 20 that transmits the locking and unlocking signal to the receiver 19 in the electronic lock 14 is electrically connected with a smoke detector/alarm 21. The circuitry of the smoke detector/alarm 21 is conventional in the art, and therefore not shown and described in detail. The circuitry of the smoke detector/alarm 21 is modified by the addition of a relay 22 which is electrically connected to the alarm power supply, such as a 9 volt DC battery 23 to supply operating power.

The signal transmitter 20 is preferably powered by two lithium batteries and has an "unlock" switch 24 and a "lock" switch 25. Preferably, the present system utilizes radio frequency signals (RF) rather that infrared, because the radio frequency signal will work long range—between around 30 to 100 feet or more, whereas an infra-red signal would only be effective for a much shorter range.

A first pair of contacts of the relay 22 are electrically connected by leads 22A to the existing alarm "power on" circuit such that the relay is activated simultaneously with the sounding of the alarm 21A. A second pair of contacts of the relay 22 are electrically connected by leads 22B to the "unlock" switch 24 of the signal transmitter 20. The "lock" switch 25 of the transmitter 20 may be a pushbutton switch, which may be operated manually by removing the cover of the smoke detector/alarm, or it may be connected to a pushrod that extends through the cover of the smoke detector/alarm. Alternatively, the "lock" switch 25 of the transmitter 20 may be electrically connected to the existing pushbutton reset switch of the smoke detector/alarm to be actuated simultaneously with the pushbutton reset switch.

The remote control transmitter 20 and the signal receivers 19 of the locks 14 on all of the burglar bars of the premises are programmed such that all of the locks are actuated simultaneously by the signal generated by the transmitter. A second small hand-held remote control transmitter, which is programmed to actuate all of the burglar bar locks of the premises, may also be provided or use in operating the locks 14 under normal non-emergency conditions.

It should be understood that if the premises is provided with conventional electronic door locks and/or an automatic garage door opener, the door locks and garage door opener may be programmed such that they will be actuated simultaneously with the burglar bar locks by the signal generated by the transmitter.

Operation

When the smoke detector/alarm 21 senses smoke in the premises, its alarm 21A is "powered on" to sound the alarm. The relay 22 is activated simultaneously with the sounding of the alarm 21A. The relay 22 activates the "unlock" switch 24 of the transmitter 20 to transmit an RF "unlock" signal.

Each of the receivers 19 of the electronic locks 14 receive the transmitted signal, and activate their actuator 16, which, in turn actuates the mechanism 17 to retract the bolt 15 through the aperture 11A in the peripheral side of the grill 11 and withdraw it from the adjacent aperture 10A in the surrounding frame 10, thus quickly automatically unlocking the burglar bars without human intervention and allowing them to be swung upon.

To reset the locks 14, the "lock" switch 25 of the transmitter 20 is activated to transmit an RF "lock" signal. The "lock" signal is received by each of the receivers 19 of the electronic locks 14 which activates their actuator 16, which, in turn actuates the mechanism 17 to extend the bolt 15 through the aperture 11A in the peripheral side of the grill 11 and into the adjacent aperture 10A in the surrounding frame 10, thus automatically locking the burglar bars. If the "lock" switch 25 of the transmitter 20 is a pushbutton switch, it is activated manually by removing the cover of the smoke detector/alarm and depressing it or, if it is connected to a pushrod that extends through the cover of the smoke detector/alarm, by depressing the pushrod. If the "lock" switch 25 of the transmitter 20 is electrically connected to the existing pushbutton reset switch of the smoke detector/alarm it may be actuated by depressing the existing pushbutton reset switch.

While this invention has been described fully and completely with special emphasis upon a preferred embodiment, it should be understood that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An emergency release burglar bar apparatus actuated remotely by a signal generated by a smoke detector alarm, comprising:

a frame for surrounding a window or door opening in a building;

a grate hingedly connected with said frame movable between a closed position over said opening and an open position away from said opening;

releasable electronic lock means including an actuator connected with a retractable locking bar engageable between said frame and said grate to prevent hinged movement of said grate away from said opening in a locked condition and to allow hinged movement thereof away from said opening in an unlocked condition;

signal receiver means operatively connected with said actuator to receive a wireless signal generated by the smoke detector alarm, and upon receipt thereof, said actuator moving said retractable locking bar to said unlocked condition, allowing said grate to be swung open.

2. The emergency release burglar bar apparatus according to claim 1, wherein said actuator connected with said retractable locking bar by a mechanism selected from the group consisting of a connecting rod, a solenoid, a motor, and a gear drive.

3. The emergency release burglar bar apparatus according to claim 1, wherein said actuator is powered by one or more DC batteries.

4. The emergency release burglar bar apparatus according to claim 1, further comprising:

the smoke detector alarm having an electronic circuit with a relay connected with a wireless signal transmitter having an electronic unlock switch that is activated simultaneously upon detection of smoke and sounding of the alarm to send said wireless signal to said signal receiver means.

5. The emergency release burglar bar apparatus according to claim 4, wherein said wireless signal transmitter has a manually operated lock switch that, upon activation, sends a wireless lock signal to said signal receiver means, and upon said signal receiver means receiving said wireless lock signal, said actuator moves said retractable locking bar to said locked condition, preventing said grate from being swung open.

6. The emergency release burglar bar apparatus according to claim 5, wherein said smoke detector alarm electronic circuit has a pushbutton reset switch for resetting said alarm; and said manually operated lock switch is electrically connected to said pushbutton reset switch to be actuated simultaneously with said pushbutton reset switch.

7. The emergency release burglar bar apparatus according to claim 4, further comprising:

a portable wireless signal transmitter having an electronic unlock switch and an electronic lock switch that are selectively activated by a user to send either of a wireless unlock signal or a wireless lock signal to said signal receiver means;

upon said signal receiver means receiving said wireless unlock, said actuator moving said retractable locking bar to said unlocked condition, allowing said grate to be swung open; and upon said signal receiver means receiving said wireless lock signal, said actuator moving said retractable locking bar to said locked condition, preventing said grate from being swung open; whereby said grate may be selectively moved between said open position and said closed position under normal non-emergency conditions.

8. The combination of burglar bar apparatus and a smoke detector alarm, comprising:

a frame for surrounding a window or door opening in a building;

a grate hingedly connected with said frame movable between a closed position over said opening and an open position away from said opening;

releasable electronic lock means including an actuator connected with a retractable locking bar engageable between said frame and said grate to prevent hinged movement of said grate away from said opening in a locked condition and to allow hinged movement thereof away from said opening in an unlocked condition;

signal receiver means operatively connected with said actuator to receive a wireless signal generated by a smoke detector alarm, and upon receipt thereof, said actuator moving said retractable locking bar to said unlocked condition, allowing said grate means to be swung open; and the smoke detector alarm having an electronic circuit with a relay connected with a wireless signal transmitter having an electronic unlock switch that is activated simultaneously upon detection of smoke and sounding of the alarm to send said wireless signal to said signal receiver means.

9. The combination according to claim 8, wherein said wireless signal transmitter has a manually operated lock switch that, upon activation, sends a wireless lock signal to said signal receiver means, and upon said signal receiver means receiving said wireless lock signal, said actuator moves said retractable locking bar to said locked condition, preventing said grate from being swung open.

10. The combination according to claim 9, wherein said smoke detector alarm electronic circuit has a pushbutton reset switch for resetting said alarm; and said manually operated lock switch is electrically connected to said pushbutton reset switch to be actuated simultaneously with said pushbutton reset switch.

11. A method for allowing persons to escape a building having a security grate covering door or window openings of the building upon detection of smoke in the building, comprising the steps of:

providing a hinged connection between the grate and a frame surrounding the window or door opening of the building whereby the grate is movable between a closed position over said opening and an open position away from said opening;

providing releasable electronic lock means including signal receiver means operatively connected with an actuator connected with a retractable locking bar which is engageable between the frame and the grate to prevent hinged movement of the grate away from the opening in a locked condition and to allow hinged movement thereof away from the opening in an unlocked condition; and providing a smoke detector alarm with an electronic circuit with a relay connected with a wireless signal transmitter having an electronic unlock switch that is activated simultaneously upon detection of smoke and sounding of the alarm to send a wireless signal to said signal receiver means; wherein said signal receiver means receives a wireless signal generated by said smoke detector alarm, and upon receipt thereof, said actuator moves said retractable locking bar to said unlocked condition, allowing said grate to be swung open.

12. The method according to claim 11, comprising the further step of:

providing said wireless signal transmitter with a manually operated lock switch that, upon activation, sends a wireless lock signal to said signal receiver means, and selectively manually operating said manually operated lock switch to send said wireless lock signal whereby upon said signal receiver means receiving said wireless lock signal, said actuator moves said retractable locking bar to said locked condition, preventing said grate from being swung open.

13. The method according to claim 12, comprising the further step of:

electrically connecting said manually operated lock switch with a pushbutton reset switch of said smoke detector alarm to be to be actuated simultaneously with said pushbutton reset switch whereby said actuator moves said retractable locking bar to said locked condition, preventing said grate from being swung open, upon depressing said pushbutton reset switch.

14. The method according to claim 11, comprising the further step of:

providing a portable wireless signal transmitter having an electronic unlock switch and an electronic lock switch that are selectively activated by a user to send either of a wireless unlock signal or a wireless lock signal to said signal receiver means;

upon said signal receiver means receiving said wireless unlock, said actuator moving said retractable locking bar to said unlocked condition, allowing said grate to be swung open; and upon said signal receiver means receiving said wireless lock signal, said actuator moving said retractable locking bar to said locked condition, preventing said grate from being swung open; whereby said grate may be selectively moved between said open position and said closed position under normal non-emergency conditions.

* * * * *